US005241171A

United States Patent [19]

Fraenkel

[11] Patent Number: 5,241,171

[45] Date of Patent: Aug. 31, 1993

[54] SUPPORT MEMBER HAVING LAYERS SENSITIVE TO DIFFERENT WAVELENGTHS

[75] Inventor: Herbert Fraenkel, London, England

[73] Assignee: Sortex Limited, London, England

[21] Appl. No.: 935,520

[22] Filed: Aug. 25, 1992

[51] Int. Cl.[5] ..... H01J 3/14

[52] U.S. Cl. ..... 250/223 R; 209/577

[58] Field of Search ..... 250/221, 222.2, 223 R, 250/226, 571; 209/511, 577-581

[56] References Cited

U.S. PATENT DOCUMENTS 4,057,352 11/1977 Babb ..... 250/226
4,352,430 10/1982 Maier et al. ..... 209/577
4,609,108 9/1986 Hristozov et al. ..... 209/581
4,917,500 4/1990 Lugos ..... 250/226

*Primary Examiner*—David C. Nelms
*Assistant Examiner*—Stephone Allen
*Attorney, Agent, or Firm*—Palmatier, Sjoquist & Helget

[57] ABSTRACT

A support member for supporting objects undergoing inspection, the support member having an uppermost layer whose color is highly reflective in predetermined wavelengths in the range 580 to 1000 nm, the uppermost layer being in direct contact with a further layer which further layer is disposed below the uppermost layer and which reflects at least 70% of any light falling on it having predetermined wavelengths in the range 360 nm to 870 nm.

11 Claims, 1 Drawing Sheet

SUPPORT MEMBER HAVING LAYERS SENSITIVE TO DIFFERENT WAVELENGTHS

BACKGROUND OF THE INVENTION

This invention concerns a support member, e.g. an endless belt, for supporting objects undergoing inspection, and although the invention is not so restricted it concerns more particularly inspection apparatus, e.g. as provided in a sorting machine, in which objects may be inspected under illumination such as visible, infrared or ultraviolet light.

The term "objects" is used in this specification in a wide sense so as to include, inter alia, agricultural material, e.g. peas, beans, tomatoes, potatoes and potato slices for use in French fries, coffee and rice, and mineral material, e.g. diamonds and pieces of ore.

DESCRIPTION OF THE PRIOR ART

In photometric wide flat belt sorting machines it is sometimes convenient to examine the product to be sorted while it is resting on an endless belt which conveys the product from a hopper or other container to a region in which acceptable product is separated from unacceptable product and/or from foreign material. Since such unacceptable product and foreign material may be darker than the acceptable product in certain parts of the spectrum, it is important that the belt should be at least nearly as reflective as the acceptable product in such parts of the spectrum. If this were not the case, when the machine viewed the belt itself, e.g. by reason of there being a space between adjacent objects being viewed, the resultant signal would be the same as that produced by an object which was darker than an acceptable object. Consequently, the machine would need to be desensitised in order to effect sorting and would thus miss defects on an object or objects of smaller or lesser discoloration.

For certain applications a white belt may be used. However, if it desired to reject simultaneously objects which are too "light", e.g. by using a light splitter and a second detector (preferably via a coloured filter), a white belt is unsuitable since white belts normally have maximum reflectivity right through the visible and near infrared range, thus making impossible a "light" sort (i.e. a sort for objects which are too "light").

The provision of a satisfactory belt in this connection has proved quite difficult. For example, if a belt were to be used which was of conventional construction but which was colored orange, this could theoretically enable both a "dark" reject sort (i.e. a sort for the removal of too "dark" objects) in the infrared, and a "light" reject sort (i.e. a sort for the removal of too "light" objects) to be effected in, say, the green part of the spectrum. However, much of the infrared light would penetrate through the belt with the result that the latter would appear to be relatively "dark" in the infrared.

An object of the present invention is thus to provide a belt which is satisfactory in this connection.

SUMMARY OF THE INVENTION

According to the present invention, there is provided a support member for supporting objects undergoing inspection, the support member having an uppermost layer whose color is highly reflective in predetermined wavelengths in the range 580 to 1000 nm, the uppermost layer being in direct contact with a further layer which is disposed below the uppermost layer and which further layer reflects at least 70% of any light falling on it having predetermined wavelengths in the range 360 nm to 870 nm.

The support member as a whole preferably reflects less than 25% of any light falling on it having predetermined wavelengths in the range 450–550 nm, and reflects at least 70% of any light falling on it having predetermined wavelengths in the range 750–870 nm.

The uppermost layer is preferably bonded to the further layer.

Alternatively, the further layer may be constituted by a plate or bar.

In the case where the uppermost layer is bonded to the further layer, the support member is preferably an endless belt. In this case, it is preferably arranged that the joint between the ends of the member used to form the endless belt is not substantially darker than the rest of the belt.

The uppermost layer may be coloured orange and the said further layer may be coloured white.

Preferably the support member has a lowermost layer, e.g. a woven fabric layer, which carries the further layer and the uppermost layer.

Preferably, the various layers of the support member are strongly adherent to each other so as to be effectively integral.

The invention also includes inspection apparatus comprising a support member for supporting objects undergoing inspection, the support member having an uppermost layer whose color is highly reflective in predetermined wavelengths in the range 580 to 1000 nm, the uppermost layer being in direct contact with a further layer which is disposed below the uppermost layer and which further layer reflects at least 70% of any light falling on it having predetermined wavelengths in the range 360 nm to 870 nm, means for directing visible and/or ultraviolet light and also infrared light onto objects supported by the said uppermost layer, viewing means for viewing the objects onto which the said light is directed, and display and/or control means responsive to the viewing means for displaying data relating to the objects and/or for exercising a control in response to such data.

Additionally, the invention includes a sorting machine comprising an endless belt having an uppermost layer whose color is highly reflective in predetermined wavelengths in the range 580 to 1000 nm, the uppermost layer being in direct contact with a further layer which is disposed below the uppermost layer and which further layer reflects at least 70% of any light falling on it having predetermined wavelengths in the range 360 nm to 870 nm; means for feeding objects to be sorted onto the uppermost layer for carriage by the endless belt through an inspection zone; means for directing visible and/or ultraviolet light and also infra-red light onto objects in the inspection zone; viewing means for viewing objects in the inspection zone; separator means for effecting relative separation between desired and undesired objects; and control means, resonsive to the viewing means, for controlling the operation of the separator means.

BRIEF DESCRIPTION OF THE DRAWINGS

The invention is illustrated, merely by way of example, in the accompanying drawings, in which.

DETAILED DESCRIPTION OF THE PREFERRED EMBODIMENT

Figure 1:
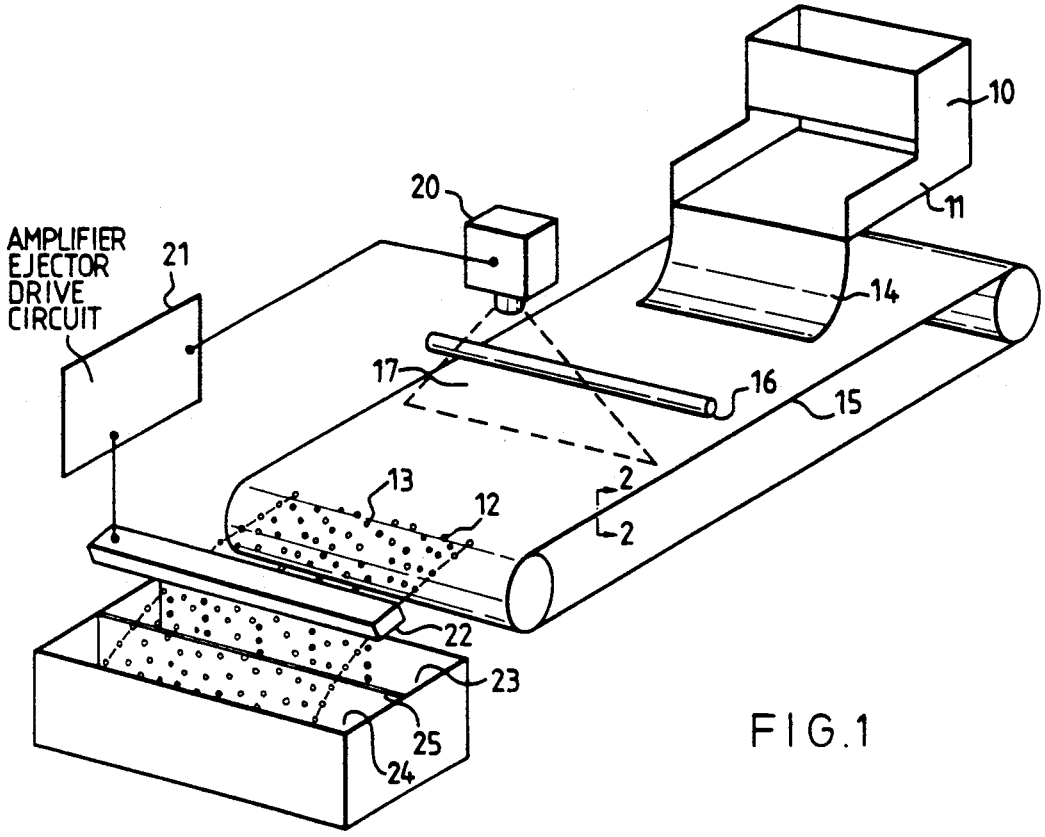
FIG. 1 is a diagrammatic perspective view of a sorting machine provided with a support member in accordance with the present invention.

Referring to the drawings, a sorting machine comprises a hopper 10 which is integral with a feed tray 11. The latter is vibrated (by means not shown) so that objects 12, 13 to be sorted pass from the hopper 10 and via the feed tray 11 and a chute 14 to the top run of an endless belt 15. The objects 12, 13 are carried by the endless belt 15 below light source means 16, e.g. light source means producing visible light and infrared light, in an inspection zone 17. The objects 12, 13 in the inspection zone 17 are viewed by a scanning camera 20 which is arranged to send signals to a control means and ejector drive circuit 21. The latter controls the operation of a separator 22 for effecting relative separation between the desired objects 13 and the undesired objects 12. The separator 22 may be constituted by a bank of air ejectors which are controlled by the circuit 21 so that relevant ejectors are actuated to cause the undesired objects 12 to pass into a reject receptacle 23 while the desired objects 13 pass into an accept receptacle 24, the receptacles 23, 24 being separated by a dividing partition 25.

Figure 2:
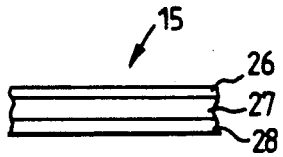
FIG. 2 is a broken away cross-sectional view on the line 2—2 of FIG. 1.

As shown in FIG. 2, the endless belt 15 is made up of three layers, namely an uppermost layer 26 whose color is highly reflective in predetermined wavelengths in the range 580 to 1000 nm and especially in the range 580 to 870 nm, a further layer 27 which is disposed below and in direct contact with the uppermost layer 26 and which reflects at least 70% of any light falling on it in predetermined wavelengths in the range 360 nm to 870 nm, and a lowermost layer 28 which carries the the further layer 27 and the uppermost layer 26.

In one specific example, the uppermost layer 26 which is about 0.25 mm thick and which has been coated onto the further layer 27, is made up of 50% PVC resin and about 5% of orange pigment, the remainder being constituted by heat stabilisers and calcium carbonate filler. The orange pigment is a blend of non-organic pigments in di-octyl-phthalate plasticiser and dispersing agents. The orange pigment causes the reflectivity of the endless belt 15 to be approximately 5% between 450 nm and 550 nm rising to substantially 77% reflectivity between 750 nm and 870 nm.

The further layer 27, which is about 0.65 mm thick, is made up of 45–50% PVC, 4–5% white titanium dioxide pigment, not more than 5% heat stabiliser, and not more than 5% bonding agent, the rest being a filler consisting mostly of calcium carbonate and polymeric as well as phthalate plasticisers. The provision of this further layer 27 enables the endless belt 15 to have a reflectivity of about 80% in the near infrared (between 750 and 870 nm) even when the endless belt 15 is viewed against a conventional black background. This 80% reflectivity in the near infrared is significantly more than the 60% reflectivity which would normally be obtainable without the provision of the further layer 27.

The lowermost layer 28, onto which the further layer 27 was coated, is a woven 2 ply layer of polyester plastics material laminated with polyurethane adhesive. The layer 28, which has a total thickness of 1 mm, has a monofilament weft with a thickness of 0.25 mm and a multifilament warp. Onto this lowermost layer 28 there are thus coated first the further layer 27 and then the uppermost layer 26 on top of the further layer 27.

The opposite ends of the endless belt 15 are secured together by vulcanising the belt joint with one pressing action by means of top and bottom platen plates at 170° C. for 2 minutes. The resultant joint is not substantially darker than the rest of the belt. It is desirable to keep the time and temperature of the vulcanisation to a minimum consistent with adequate tensile strength at the joint.

The resultant endless belt 15 is thus of multilayer construction whose layers 26, 27, 28 are effectively integral with each other.

It is alternatively possible for the uppermost layer which has the color referred to above to be constituted by an endless belt made up of a single PVC layer, or by a PVC layer bonded to a woven layer, and to pass over and in contact with a further layer constituted by a white member such as a white bar or plate in the inspection zone 17. However, this gives rise to progressive deterioration of the color of the underside of the endless belt and also gives rise to light loss because of the two additional interfaces between the white bar or plate and the single PVC layer by comparison with the construction described above.

I claim:

1. A support member for supporting objects undergoing inspection, the support member having an uppermost layer whose color is highly reflective in predetermined wavelengths in the range 580 to 1000 nm, the uppermost layer being in direct contact with a further layer which is disposed below the uppermost layer and which further layer reflects at least 70% of any light falling on it having predetermined wavelengths in the range 360 nm to 870 nm.

2. A support member as claimed in claim 1 in which the support member as a whole reflects less than 25% of any light falling on it having predetermined wavelengths in the range 450–550 nm, and reflects at least 70% of any light falling on it having predetermined wavelengths in the range 750–870 nm.

3. A support member as claimed in claim 1 in which the uppermost layer is bonded to the further layer.

4. A support member as claimed in claim 3 in which the support member is an endless belt.

5. A support member as claimed in claim 4 in which the joint between the ends of the member used to form the endless belt is not substantially darker than the rest of the belt.

6. A support member as claimed in claim 1 in which the further layer is constituted by a plate or bar.

7. A support member as claimed in claim 1 in which the uppermost layer is coloured orange and the said further layer is coloured white.

8. A support member as claimed in claim 1 in which the support member has a lowermost layer which carries the further layer and the uppermost layer.

9. A support member as claimed in claim 1 or claim 8 in which the various layers of the support member are strongly adherent to each other so as to be effectively integral.

10. Inspection apparatus comprising a support member for supporting objects undergoing inspection, the support member having an uppermost layer whose color is highly reflective in predetermined wavelengths in the range 580 to 1000 nm, the uppermost layer being in direct contact with a further layer which is disposed below the uppermost layer and which further layer reflects at least 70% of any light falling on it having predetermined wavelengths in the range 360 nm to 870 nm, means for directing visible and/or ultraviolet light and also infrared light onto objects supported by the said uppermost layer, viewing means for viewing the objects onto which the said light is directed, and display and/or control means responsive to the viewing means for displaying data relating to the objects and/or for exercising a control in response to such data.

11. A sorting machine comprising an endless belt having an uppermost layer whose color is highly reflective in predetermined wavelengths in the range 580 to 870 nm, the uppermost layer being in direct contact with a further layer which is disposed below the uppermost layer and which further layer reflects at least 70% of any light falling on it having predetermined wavelengths in the range 360 nm to 870 nm; means for feeding objects to be sorted onto the uppermost layer for carriage by the endless belt through an inspection zone; means for directing visible and/or ultraviolet light and also infra-red light onto objects in the inspection zone; viewing means for viewing objects in the inspection zone; separator means for effecting relative separation between desired and undesired objects; and control means, responsive to the viewing means, for controlling the operation of the separator means.

* * * * *